US010000833B2

(12) United States Patent
Kitsuya et al.

(10) Patent No.: US 10,000,833 B2
(45) Date of Patent: Jun. 19, 2018

(54) THICK, TOUGH, HIGH TENSILE STRENGTH STEEL PLATE AND PRODUCTION METHOD THEREFOR

(71) Applicant: JFE Steel Corporation, Tokyo (JP)

(72) Inventors: Shigeki Kitsuya, Kurashiki (JP); Naoki Matsunaga, Kawasaki (JP); Katsuyuki Ichimiya, Kurashiki (JP); Kazukuni Hase, Kurashiki (JP); Shigeru Endo, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 375 days.

(21) Appl. No.: 14/770,853

(22) PCT Filed: Mar. 11, 2014

(86) PCT No.: PCT/JP2014/001378
§ 371 (c)(1),
(2) Date: Aug. 27, 2015

(87) PCT Pub. No.: WO2014/141697
PCT Pub. Date: Sep. 18, 2014

(65) Prior Publication Data

US 2016/0010192 A1 Jan. 14, 2016

(30) Foreign Application Priority Data

Mar. 15, 2013 (JP) ..... 2013-052905

(51) Int. Cl.

| | |
|---|---|
| ***C22C 38/50*** | (2006.01) |
| ***C22C 38/58*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/54*** | (2006.01) |
| ***C21D 1/78*** | (2006.01) |
| ***C21D 6/00*** | (2006.01) |
| ***C21D 8/02*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |

(Continued)

(52) U.S. Cl.

CPC ..... *C22C 38/58* (2013.01); *C21D 1/25* (2013.01); *C21D 1/78* (2013.01); *C21D 6/004* (2013.01); *C21D 6/005* (2013.01); *C21D 6/008* (2013.01); *C21D 8/021* (2013.01); *C21D 8/0205* (2013.01); *C21D 8/0226* (2013.01); *C21D 8/0263* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/20* (2013.01); *C22C 38/22* (2013.01); *C22C 38/24* (2013.01); *C22C 38/28* (2013.01); *C22C 38/32* (2013.01); *C22C 38/38* (2013.01); *C22C 38/42* (2013.01); *C22C 38/44* (2013.01); *C22C 38/46* (2013.01); *C22C 38/50* (2013.01); *C22C 38/54* (2013.01); *C21D 2211/001* (2013.01); *C21D 2211/002* (2013.01); *C21D 2211/004* (2013.01); *C21D 2211/008* (2013.01)

(58) Field of Classification Search

CPC .. C21D 9/46; C21D 6/004; C21D 6/00; C22C 38/58; C22C 38/54; C22C 38/50

See application file for complete search history.

(56) References Cited

U.S. PATENT DOCUMENTS

2011/0041965 A1* 2/2011 Hoshino ..... C21D 8/02 148/645
2011/0253271 A1* 10/2011 Kumagai ..... B66C 23/62 148/645

(Continued)

FOREIGN PATENT DOCUMENTS

EP 2 006 407 12/2008
JP 55-114404 A 9/1980

(Continued)

OTHER PUBLICATIONS

Canadian Office Action dated Oct. 28, 2016, of corresponding Canadian Application No. 2,899,570.
Korean Office Action dated Jun. 28, 2016, of corresponding Korean Application No. 10-2015-7024160, along with a Concise Statement of Relevance of Office Action in English.
Chinese Office Action dated Jan. 13, 2017, of corresponding Chinese Application No. 201480010405.1, along with a Search Report in English.
Japanese Office Action dated Sep. 15, 2015, of corresponding Japanese Application No. 2015-505297, along with a Concise Statement of Relevance of Office Action in English.

(Continued)

*Primary Examiner* — Scott Kastler
(74) *Attorney, Agent, or Firm* — RatnerPrestia

(57) ABSTRACT

A thick, high-toughness high-strength steel plate has excellent strength and toughness in the central area through the plate thickness. The thick steel plate has a specific chemical composition and includes a microstructure having, throughout an entire region in the plate thickness direction, an average prior austenite grain size of not more than 50 μm and a martensite and/or bainite phase area fraction of not less than 80%. A continuously cast slab having the specific chemical composition is heated to 1200° C. to 1350° C., hot worked with a strain rate of not more than 3/s and a cumulative working reduction of not less than 15%, and thereafter hot rolled and heat treated.

9 Claims, No Drawings

(51) Int. Cl.

| | |
|---|---|
| ***C22C 38/20*** | (2006.01) |
| ***C22C 38/22*** | (2006.01) |
| ***C22C 38/24*** | (2006.01) |
| ***C22C 38/28*** | (2006.01) |
| ***C22C 38/32*** | (2006.01) |
| ***C22C 38/38*** | (2006.01) |
| ***C21D 1/25*** | (2006.01) |

(56) References Cited

U.S. PATENT DOCUMENTS

| | | | | |
|---|---|---|---|---|
| 2017/0044639 | A1* | 2/2017 | Kitsuya | C21D 8/02 |
| 2017/0088913 | A1* | 3/2017 | Kitsuya | C21D 9/46 |

FOREIGN PATENT DOCUMENTS

| | | | |
|---|---|---|---|
| JP | 57-127504 | A | 8/1982 |
| JP | 61-273201 | A | 12/1986 |
| JP | 05-185104 | A | 7/1993 |
| JP | 10-088231 | A | 4/1998 |
| JP | 10-265893 | A | 10/1998 |
| JP | 2000-263103 | A | 9/2000 |
| JP | 2002-194431 | A | 7/2002 |
| JP | 3333619 | B2 | 7/2002 |
| JP | 2004-237291 | | 8/2004 |
| JP | 2006-111918 | A | 4/2006 |
| JP | 2008-308736 | | 12/2008 |
| JP | 2010-106298 | A | 5/2010 |
| JP | 2010-280976 | A | 12/2010 |

OTHER PUBLICATIONS

Supplementary European Search Report dated Mar. 18, 2016, of corresponding European Application No. 14763386.1.

Naoki Okumura et al., "Effect of Hot Rolling Conditions on Annihilation of Porosities in Continuous Casting Slabs," Tetsu-to-Hagane (Irong and Steel), vol. 66, No. 2, 1980, pp. 201-210 (Abstract only).

Chinese Office Action dated May 26, 2016, of corresponding Chinese Application No. 201480010405.1, along with an English translation of the Search Report.

Canadian Office Action dated Dec. 8, 2017, of corresponding Canadian Application No. 2,899,570.

European Communication dated Mar. 1, 2018, of corresponding European Application No. 14763386.1.

* cited by examiner

THICK, TOUGH, HIGH TENSILE STRENGTH STEEL PLATE AND PRODUCTION METHOD THEREFOR

TECHNICAL FIELD

This disclosure relates to thick high-toughness high-strength steel plates with excellent strength, toughness and weldability used for steel structures such as buildings, bridges, marine vessels, marine structures, construction and industrial machineries, tanks and penstocks, and to methods of manufacturing such steel plates. The steel plates preferably have a plate thickness of 100 mm or more and a yield strength of 620 MPa or more.

BACKGROUND

In recent years, significant upsizing of steel structures has led to a marked increase in the strength and the thickness of steel that is used. Thick steel plates having a plate thickness of 100 mm or more are usually manufactured by slabbing a large steel ingot produced by an ingot making method, and hot rolling the resultant slab. In this ingot making-slabbing process, densely segregated areas in hot tops and negatively segregated areas in ingot bottoms have to be discarded. This causes low yields, high production costs and long work periods.

In contrast, a process using a continuously cast slab as the material steel is free from such concerns. However, the fact that the thickness of a continuously cast slab is less than that of an ingot slab causes the rolling reduction to the product thickness to be low. In the production of thick steel plates having increased strength, alloying elements are added in large amounts to ensure desired characteristics. This results in the occurrence of center porosities ascribed to center segregation, and the upsizing of steels consequently encounters the problematic deterioration of internal quality.

To solve this problem, the following techniques have been proposed for the purpose of improving the characteristics of center segregation areas by compressing center porosities during the process in which continuously cast slabs are worked into ultrathick steel plates.

Tetsu to Hagane (Iron and Steel), Vol. 66 (1980), No. 2, pp. 201-210 describes a technique in which center porosities are compressed by increasing the rolling shape factor during the hot rolling of a continuously cast slab. Japanese Unexamined Patent Application Publication Nos. 55-114404 and 61-273201 describe techniques in which center porosities in a continuously cast slab are compressed by working the continuously cast slab with rolls or anvils during its production in the continuous casting machine.

Japanese Patent No. 3333619 describes a technique in which a continuously cast slab is worked into a thick steel plate with a cumulative reduction of not more than 70% such that the slab is forged before hot rolling to compress center porosities. Japanese Unexamined Patent Application Publication No. 2002-194431 describes a technique in which a continuously cast slab is worked into an ultrathick steel plate by forging and thick plate rolling with a total working reduction of 35 to 67%. In that process, the central area through the plate thickness of the steel is held at a temperature of 1200° C. or above for at least 20 hours before forging and the steel is forged with a reduction of not less than 16% to eliminate center porosities and also to decrease or remedy the center segregation zone, thereby improving temper brittleness resistance characteristics.

Japanese Unexamined Patent Application Publication No. 2000-263103 describes a technique in which a continuously cast slab is cross forged and then hot rolled to remedy center porosities and center segregation. Japanese Unexamined Patent Application Publication No. 2006-111918 describes a technique related to a method of manufacturing thick steel plates with a tensile strength of not less than 588 MPa in which a continuously cast slab is held at a temperature of 1200° C. or above for at least 20 hours, forged with a reduction of not less than 17%, subjected to thick plate rolling with a total reduction including the forging reduction of 23 to 50%, and quench hardened two times after the thick plate rolling, thereby eliminating center porosities and also decreasing or remedying the center segregation zone.

Japanese Unexamined Patent Application Publication No. 2010-106298 describes a technique related to a method of manufacturing thick steel plates with excellent weldability and ductility in the plate thickness direction wherein a continuously cast slab having a prescribed chemical composition is reheated to 1100° C. to 1350° C. and thereafter worked at not less than 1000° C. with a strain rate of 0.05 to 3/s and a cumulative working reduction of not less than 15%.

The technique described in Tetsu to Hagane (Iron and Steel), Vol. 66 (1980), No. 2, pp. 201-210 requires that steel plates be repeatedly rolled with a high rolling shape factor to achieve good internal quality. However, such rolling is beyond the upper limit of equipment specifications of rolling machines and, consequently, manufacturing constraints are encountered.

The techniques of JP '404 and JP '201 have a problem in that large capital investments are necessary for adaptation of continuous casting facilities, and also have uncertainty about the strength of steel plates obtained. The techniques of JP '619, JP '431, JP '103, JP '918 and JP '298 are effective to remedy center porosities and improve center segregation zones. However, the yield strength of steel plates obtained is less than 620 MPa. Thick steel plates with a yield strength of 620 MPa or above decrease their toughness due to the increase in strength. Further, thick steel plates are cooled at a lower rate in the central area through the plate thickness than in the other areas. It is necessary to increase the amounts of alloying elements that are added to ensure strength in such central regions. Such thick steel plates containing large amounts of alloying elements increase their deformation resistance and, consequently, center porosities are not sufficiently compressed and tend to remain after the working. Thus, there is a concern that the steel plates will exhibit insufficient elongation and toughness in the central area through the plate thickness. As discussed above, there are no established techniques which realize thick high-toughness high-strength steel plates having a yield strength of 620 MPa or above, and methods of manufacturing such steel plates with existing facilities.

It could therefore be helpful to provide thick high-toughness high-strength steel plates with a yield strength of 620 MPa or above that contain large amounts of alloying elements and still have excellent strength and toughness in the central area through the plate thickness, as well as to provide methods of manufacturing such steel plates. The plate thickness of interest is 100 mm or more.

SUMMARY

We carried out extensive studies with respect to thick steel plates having a yield strength of not less than 620 MPa and a plate thickness of not less than 100 mm and found a relationship between the microstructure and the strength and toughness in the central area through the plate thickness. We thus provide:

1. A thick high-toughness high-strength steel plate having a plate thickness of not less than 100 mm, the steel plate including a microstructure having, throughout an entire region in the plate thickness direction, an average prior austenite grain size of not more than 50 μm and a martensite and/or bainite phase area fraction of not less than 80%.
2. The thick high-toughness high-strength steel plate described in 1, wherein the yield strength is not less than 620 MPa.
3. The thick high-toughness high-strength steel plate described in 1 or 2, wherein the reduction of area after fracture in a tensile test in the direction of the plate thickness of the steel plate is not less than 25%.
4. A method of manufacturing a thick high-toughness high-strength steel plate having a plate thickness of not less than 100 mm, the steel plate including a microstructure having, throughout an entire region in the plate thickness direction, an average prior austenite grain size of not more than 50 μm and a martensite and/or bainite phase area fraction of not less than 80%, the method including heating a continuously cast slab to 1200° C. to 1350° C., hot working the slab at not less than 1000° C. with a strain rate of not more than 3/s and a cumulative working reduction of not less than 15%, and thereafter hot rolling, quench hardening and tempering the steel, the continuously cast slab including, by mass %, C: 0.08 to 0.20%, Si: not more than 0.40%, Mn: 0.5 to 5.0%, P: not more than 0.015%, S: not more than 0.0050%, Cr: not more than 3.0%, Ni: not more than 5.0%, Ti: 0.005% to 0.020%, Al: 0.010 to 0.080%, N: not more than 0.0070% and B: 0.0003 to 0.0030%, the balance being Fe and inevitable impurities, the continuously cast slab satisfying the relationship represented by Expression (1):

$$Ceq^{IIW}=C+Mn/6+(Cu+Ni)/15+(Cr+Mo+V)/5\geq 0.57 \quad (1)$$

wherein the alloying element symbols indicate the respective contents (mass %) and are 0 when absent.
5. The method of manufacturing a thick high-toughness high-strength steel plate described in 4, wherein the yield strength is not less than 620 MPa.
6. The method of manufacturing a thick high-toughness high-strength steel plate described in 4 or 5, wherein the slab further includes, by mass %, one, or two or more of Cu: not more than 0.50%, Mo: not more than 1.00% and V: not more than 0.200%.
7. The method of manufacturing a thick high-toughness high-strength steel plate described in any one of 4 to 6, wherein the slab further includes, by mass %, one or both of Ca: 0.0005 to 0.0050% and REM: 0.0005 to 0.0050%.
8. The method of manufacturing a thick high-toughness high-strength steel plate described in any one of 4 to 7, wherein the continuously cast slab is heated to 1200° C. to 1350° C., hot worked at not less than 1000° C. with a strain rate of not more than 3/s and a cumulative working reduction of not less than 15%, allowed to cool naturally, heated again to Ac3 point to 1200° C., subjected to hot rolling including at least two or more passes with a rolling reduction per pass of not less than 4%, allowed to cool naturally, heated to Ac3 point to 1050° C., quenched to 350° C. or below and tempered at 450° C. to 700° C.
9. The method of manufacturing a thick high-toughness high-strength steel plate described in 8, wherein the continuously cast slab is worked to reduce the width by not less than 100 mm before hot working and is thereafter hot worked with a strain rate of not more than 3/s and a cumulative working reduction of not less than 15%.

Thick steel plates with a plate thickness of not less than 100 mm achieve excellent internal quality in the central area through the plate thickness. Specifically, the thick steel plates exhibit a yield strength of not less than 620 MPa and have excellent toughness. Our manufacturing methods can produce such steel plates. Our steel sheets have marked effects in industry by making great contributions to the upsizing of steel structures, improving the safety of steel structures, enhancing the yields, and reducing the production work periods.

DETAILED DESCRIPTION

Examples of our methods and steel sheets will be described in detail below.

Microstructure

To ensure that thick steel plates having a plate thickness of not less than 100 mm exhibit a yield strength of not less than 620 MPa and excellent toughness, the microstructure has an average prior austenite grain size of not more than 50 μm and a martensite and/or bainite phase area fraction of not less than 80% throughout an entire region in the plate thickness direction. Phases other than the martensite and/or bainite phases are not particularly limited. The average prior austenite grain size is the average grain size of prior austenite at the center through the plate thickness.

Chemical Composition

The contents of the respective elements are all in mass %.

C: 0.080 to 0.200%

Carbon is an element useful to obtain the strength required for structural steel at low cost. Addition of 0.080% or more carbon is necessary to obtain this effect. If, on the other hand, more than 0.200% carbon is added, the toughness of base steel and welds is markedly decreased. Thus, the upper limit is 0.200%. The C content is preferably 0.080% to 0.140%.

Si: Not More than 0.40%

Silicon is added for the purpose of deoxidation. However, addition of more than 0.40% silicon results in a marked decrease in the toughness of base steel and weld heat affected zones. Thus, the Si content is limited to not more than 0.40%. The Si content is preferably 0.05% to 0.30%, and more preferably 0.10% to 0.30%.

Mn: 0.5 to 5.0%

Manganese is added to ensure the strength of the base steel. However, the effect is insufficient when the amount added is less than 0.5%. Adding more than 5.0% manganese not only decreases the toughness of base steel, but also facilitates occurrence of center segregation and increases the size of center porosities in the slabs. Thus, the upper limit is 5.0%. The Mn content is preferably 0.6 to 2.0%, and more preferably 0.6 to 1.6%.

P: Not More than 0.015%

If more than 0.015% phosphorus is added, the toughness of base steel and weld heat affected zones is markedly lowered. Thus, the P content is limited to not more than 0.015%.

S: Not More than 0.0050%

If more than 0.0050% sulfur is added, the toughness of base steel and weld heat affected zones is markedly lowered. Thus, the S content is limited to not more than 0.0050%.

Cr: Not More than 3.0%

Chromium is an element effective to increase the strength of the base steel. However, addition of an excessively large amount results in a decrease in weldability. Thus, the Cr content is limited to not more than 3.0%. The Cr content is preferably 0.1% to 2.0%.

Ni: Not More than 5.0%

Nickel is a useful element that increases the strength of steel and the toughness of weld heat affected zones. However, adding more than 5.0% nickel causes a significant decrease in economic efficiency. Thus, the upper limit of the Ni content is preferably 5.0% or less. The Ni content is more preferably 0.5% to 4.0%.

Ti: 0.005% to 0.020%

Titanium forms TiN during heating to effectively suppress coarsening of austenite and enhance the toughness of the base steel and weld heat affected zones. 0.005% or more titanium is added to obtain this effect. However, addition of more than 0.020% titanium results in coarsening of titanium nitride and, consequently, the toughness of base steel is lowered. Thus, the Ti content is limited to 0.005% to 0.020%. The Ti content is preferably 0.008% to 0.015%.

Al: 0.010 to 0.080%

Aluminum is added to deoxidize molten steel. However, the deoxidation effect is insufficient if the amount added is less than 0.010%. If more than 0.080% aluminum is added, the amount of aluminum dissolved in the base steel is so increased that the toughness of base steel is lowered. Thus, the Al content is limited to 0.010 to 0.080%. The Al content is preferably 0.030 to 0.080%, and more preferably 0.030 to 0.060%.

N: Not More than 0.0070%

Nitrogen has an effect of reducing the size of the microstructure by forming nitrides with elements such as titanium, and thereby enhances the toughness of base steel and weld heat affected zones. If, however, more than 0.0070% nitrogen is added, the amount of nitrogen dissolved in the base steel is so increased that the toughness of base steel is significantly lowered and further the toughness of weld heat affected zones is decreased due to formation of coarse carbonitride. Thus, the N content is limited to not more than 0.0070%. The N content is preferably not more than 0.0050%, and more preferably not more than 0.0040%.

B: 0.0003 to 0.0030%

Boron is segregated in austenite grain boundaries and suppresses ferrite transformation from the grain boundaries, thereby exerting an effect of enhancing hardenability. To ensure that this effect is produced sufficiently, 0.0003% or more boron is added. If the amount added is more than 0.0030%, boron is precipitated as carbonitride to cause a decrease in hardenability and a decrease in toughness. Thus, the B content is limited to 0.0003% to 0.0030%. The B content is preferably 0.0005 to 0.0020%.

$Ceq^{IIW} \geq 0.57\%$

It is necessary to design the microstructure so that the central area through the plate thickness exhibits both a yield strength of not less than 620 MPa and excellent toughness. To ensure that the martensite and/or bainite phase area fraction will be 80% or more even in spite of the conditions in which the plate thickness is 100 mm or more and the central area through the plate thickness is cooled at a lower rate than the other areas, it is necessary that the components be added in such amounts that $Ceq^{IIW}$ defined by Expression (1) below satisfies the relationship: $Ceq^{IIW} \geq 0.57\%$:

$$Ceq^{IIW} = C + Mn/6 + (Cu+Ni)/15 + (Cr+Mo+V)/5 \geq 0.57 \quad (1)$$

wherein the element symbols indicate the contents (mass %) of the respective elements and are 0 when absent.

The aforementioned components constitute the basic chemical composition, and the balance is iron and inevitable impurities. The chemical composition may further include one, or two or more of copper, molybdenum and vanadium to enhance strength and toughness.

Cu: Not More than 0.50%

Copper increases the strength of steel without causing a decrease in toughness. However, adding more than 0.50% copper results in the occurrence of cracks on the steel plate surface during hot working. Thus, the content of copper, when added, is limited to not more than 0.50%.

Mo: Not More than 1.00%

Molybdenum is an element effective to increase the strength of the base steel. If, however, more than 1.00% molybdenum is added, hardness is increased by precipitation of alloy carbide and, consequently, toughness is decreased. Thus, the upper limit of molybdenum, when added, is limited to 1.00%. The Mo content is preferably 0.20% to 0.80%.

V: Not More than 0.200%

Vanadium is effective to increase the strength and toughness of base steel, and also effectively decreases the amount of solute nitrogen by being precipitated as VN. However, adding more than 0.200% vanadium results in a decrease in toughness due to the precipitation of hard VC. Thus, the content of vanadium, when added, is limited to not more than 0.200%. The V content is preferably 0.010 to 0.100%.

Further, one, or two or more of calcium and rare earth metals may be added to increase strength and toughness.

Ca: 0.0005 to 0.0050%

Calcium is an element useful to control the morphology of sulfide inclusions. 0.0005% or more calcium needs to be added to obtain its effect. If, however, the amount added exceeds 0.0050%, cleanliness is lowered and toughness is decreased. Thus, the content of calcium, when added, is limited to 0.0005 to 0.0050%. The Ca content is preferably 0.0005% to 0.0025%.

REM: 0.0005 to 0.0050%

Similar to calcium, rare earth metals have an effect of improving quality through formation of oxides and sulfides in steel. To obtain this effect, 0.0005% or more rare earth metals need to be added. The effect is saturated after the amount added exceeds 0.0050%. Thus, the content of rare earth metals, when added, is limited to 0.0005 to 0.0050%. The REM content is preferably 0.0005 to 0.0025%.

Manufacturing Conditions

The temperature "° C." refers to the temperature in the central area through the plate thickness of the slab or the steel plate. In the method of manufacturing thick steel plates, casting defects such as center porosities in the steel are eliminated by subjecting the steel to hot working and, after air cooling and reheating or directly without cooling, subjecting the hot-worked steel to hot rolling to obtain a desired plate thickness. The temperature of the central area through the plate thickness may be obtained by a method such as simulation calculation using data such as plate thickness, surface temperature and cooling conditions. For example, the temperature in the center through the plate thickness may be obtained by calculating the temperature distribution in the plate thickness direction using a difference method.

Conditions for Hot Working of Steel

Heating Temperature: 1200° C. to 1350° C.

Steel having the aforementioned chemical composition is smelted by a usual known method in a furnace such as a converter furnace, an electric furnace or a vacuum melting furnace, and is continuously cast and rolled into a slab (a steel slab), which is reheated to 1200° C. to 1350° C. If the reheating temperature is less than 1200° C., hot working cannot ensure a prescribed cumulative working reduction and further the steel exhibits high deformation resistance during hot working and fails to ensure a sufficient working reduction per pass.

As a result, the number of passes is increased to cause a decrease in production efficiency. Further, the compression cannot remedy casting defects such as center porosities in the steel. For these reasons, the reheating temperature is limited to not less than 1200° C.

On the other hand, reheating at a temperature exceeding 1350° C. consumes excessively large amounts of energy, and scales formed during heating raise the probability of surface defects, thus increasing the load in maintenance after hot working. Thus, the upper limit is limited to 1350° C. Preferably, the hot working described below is performed after the continuously cast slab is worked in the width direction at least until an increase in slab thickness is obtained. This allows center porosities to be compressed more reliably.

Width Reduction Before Hot Working—not Less than 100 mm

Preferably, the slab is worked in the width direction before hot working and thereby the slab thickness is increased to ensure a margin for working. When this working is performed, reduction of width is preferably 100 mm or more because working by 100 mm or more gives rise to a thickness increase in an area that is distant from both ends of the slab width by ¼ of the slab width. This makes it possible to effectively compress the center porosities of the slab that frequently occur in this area. The width reduction that is 100 mm or more is the total of the width reduction at both ends of the slab width.

Working Temperature in Hot Working: Not Less than 1000° C.

If the working temperature during the hot working is less than 1000° C., hot working encounters high deformation resistance. Consequently, the load on the hot working machine is increased, and reliable compression of center porosities fails. Thus, the working temperature is limited to not less than 1000° C. The working temperature is preferably 1100° C. or more.

Cumulative Working Reduction During Hot Working: Not Less than 15%

If the cumulative working reduction during hot working is less than 15%, compression fails to remedy casting defects such as center porosities in the steel. Thus, the cumulative working reduction is limited to not less than 15%. When the plate thickness (the thickness) of the slab has been increased by hot working of the continuously cast slab in the width direction, the cumulative working reduction is the reduction from the increased thickness.

In the production of thick steel plates having a plate thickness of 120 mm or more, it is preferable that the hot working include one or more passes in which the working reduction per pass is 7% or more to reliably compress the center porosities. More preferably, the working reduction per pass is 10% and above.

Strain Rate During Hot Working: Not More than 3/s

If the strain rate during the hot working exceeds 3/s, the hot working encounters high deformation resistance. Consequently, the load on the hot working machine is increased, and compression of center porosities fails. Thus, the strain rate is limited to not more than 3/s.

At a strain rate of less than 0.01/s, hot working requires an extended time to cause a decrease in productivity. Thus, the strain rate is preferably not less than 0.01/s. More preferably, the strain rate is 0.05/s to 1/s. The hot working may be performed by a known method such as hot forging or hot rolling. Hot forging is preferable from the viewpoints of economic efficiency and high degree of freedom.

By performing the hot working under the aforementioned conditions, the central area through the plate thickness achieves stable enhancement in elongation in a tensile test.

Air Cooling after Hot Working

The hot-worked steel is subjected to hot rolling to obtain a desired plate thickness. The hot rolling is performed after air cooling and reheating or is carried out directly without cooling.

Hot Rolling Conditions

The hot-worked steel is hot rolled into a steel plate having a desired plate thickness. The steel plate is then subjected to quench hardening and tempering to ensure that a yield strength of not less than 620 MPa and good toughness are exhibited even in the central area through the plate thickness of the resultant steel plate.

Temperature of Reheating of Hot-Worked Steel: Ac3 Point to 1200° C.

To obtain an austenite single phase, the hot-worked steel is heated to or above the Ac3 transformation point. At above 1200° C., the austenite structure is coarsened to cause a decrease in toughness. Thus, the reheating temperature is limited to the Ac3 point to 1200° C. The Ac3 transformation point is a value calculated using Expression (2) below:

$$Ac3=937.2-476.5C+56Si-19.7Mn-16.3Cu-26.6Ni-4.9Cr+38.1Mo+124.8V+136.3Ti+198.4Al+3315B \quad (2).$$

In Expression (2), the element symbols indicate the contents (mass %) of the respective alloying elements.

Rolling Reduction Per Pass: Two or More Passes with 4% or More Reduction

Rolling with a reduction per pass of 4% or more ensures that the recrystallization of austenite is promoted over the entire region through the plate thickness. By performing such rolling two or more times, the austenite grains attain small and regular sizes. As a result, fine prior austenite grains are formed by quench hardening and tempering and, consequently, toughness may be enhanced. More preferably, the rolling reduction per pass is 6% or more.

Conditions for Heat Treatment after Hot Tolling

To obtain strength and toughness in the central area through the plate thickness, quench hardening and tempering are performed. In the quench hardening, the hot-rolled plate is allowed to cool naturally, reheated to the Ac3 point to 1050° C., and quenched from a temperature of not less than the Ar3 point to 350° C. or below. The reheating temperature is limited to 1050° C. or below because reheating at a high temperature exceeding 1050° C. causes the austenite grains to be coarsened and thus results in a marked decrease in the toughness of base steel. The Ar3 transfor mation point is a value calculated using Expression (3) below:

$$Ar3=910-310C-80Mn-20Cu-15Cr-55Ni-80Mo \quad (3).$$

In Expression (3), the element symbols indicate the contents (mass %) of the respective alloying elements.

A general quenching method in industry is water cooling. However, because the cooling rate is desirably as high as possible, any cooling methods other than water cooling may be adopted. Exemplary methods include gas cooling.

The tempering temperature is 450° C. to 700° C. Tempering at less than 450° C. produces a small effect in removing residual stress. If, on the other hand, the temperature exceeds 700° C., various carbides are precipitated and the microstructure of the base steel is coarsened to cause a marked decrease in strength and toughness. Thus, the tempering temperature is limited to 450° C. to 700° C.

When quench hardening is performed a plurality of times for the purpose of increasing the strength and the toughness of steel, it is necessary that the final quench hardening be performed such that the steel is heated to the Ac3 point to 1050° C., quenched to 350° C. or below and tempered at 450° C. to 700° C.

Examples

Steels Nos. 1 to 29 shown in Table 1 were smelted and shaped into slabs (continuously cast slabs) having a slab thickness of 310 mm. The slabs were then hot worked and hot rolled under various conditions, thereby forming steel plates with a plate thickness of 100 mm to 240 mm. Thereafter, the steel plates were quench hardened and tempered to give product specimens Nos. 1 to 39, which were subjected to the following tests.

Microstructure Evaluation

Samples having a 10×10 (mm) observation area were obtained from the surface and the center through the plate thickness of an L cross section of the steel as quenched. The microstructure was exposed with a Nital etching solution. Five fields of view were observed with a ×200 optical microscope, and the images were analyzed to measure fractions in the microstructure. To determine the average prior austenite grain size, L cross sectional observation samples were etched with picric acid to expose the prior y grain boundaries, and the images were analyzed to measure the circular equivalent diameters of the prior y grains, the results being averaged.

Evaluation of Porosities

A sample 12.5 in thickness and 50 in length (mm) was obtained from the central area through the plate thickness. The sample was inspected for 100 μm or larger porosities with an optical microscope.

Tensile Test

Round bars as tensile test pieces (diameter 12.5 mm, GL 50 mm) were obtained from the central area through the plate thickness of each of the steel plates, along a direction perpendicular to the rolling direction. The test pieces were tested to measure the yield strength (YS), the tensile strength (TS) and the total elongation (t. El).

Charpy Impact Test

Three Charpy test pieces with a 2 mm V notch were obtained from the central area through the plate thickness of each of the steel plates such that the rolling direction was the longitudinal direction. Each of the test pieces was subjected to a Charpy impact test at −40° C. to measure the absorbed energy ($_{v}E_{-40}$), and the results were averaged.

Tensile Test in Plate Thickness Direction

Three round bars as tensile test pieces (diameter 10 mm) were obtained along the direction of the plate thickness of each steel plate. The reduction of area after fracture was measured, and the results were averaged.

Tables 2 to 5 describe the manufacturing conditions and results of the above tests. From the tables, the steel plates of the steels Nos. 1 to 16 (the specimens Nos. 1 to 16) satisfying our chemical composition of steel achieved YS of not less than 620 MPa, TS of not less than 720 MPa, t. El of not less than 16%, base steel toughness ($_{v}E_{-40}$) of not less than 70 J, and a reduction of area of not less than 25%. Thus, the base steels exhibited excellent strength and toughness.

In the steel plates of Comparative Examples (the specimens Nos. 17 to 28) which were produced from the steels Nos. 17 to 28 having a chemical composition outside our range, the characteristics of base steel were inferior and corresponded to one or more of YS of less than 620 MPa, TS of less than 720 MPa, t. El of less than 16% and toughness ($_{v}E_{-40}$) of less than 70 J. In particular, the steel No. 28 failed to satisfy the Ceq requirement, and consequently the martensite and/or bainite fraction in the central area through the plate thickness was less than 80% to cause a decrease in yield strength. Thus, the corresponding steel plate did not achieve the target strength.

Further, as demonstrated by the specimens Nos. 29 to 39, even the steel plates satisfying our chemical composition of steel were unsatisfactory in one or more characteristics of YS, TS, t. El and toughness ($vE_{-40}$) when the manufacturing conditions were outside our range. In particular, the specimen No. 39 had undergone an insufficient number of rolling passes with 4% or more reduction per pass. Consequently, it was impossible to control the average prior austenite grain size throughout the plate thickness to 50 μm or less, and the base steel exhibited poor toughness.

TABLE 1

| Categories | Steel No. | Chemical composition (mass %) | | | | | | | | | |
|---|---|---|---|---|---|---|---|---|---|---|---|
| | | C | Si | Mn | P | S | Cr | Ni | Ti | Al | N |
| Inv. Steels | 1 | 0.083 | 0.15 | 1.4 | 0.006 | 0.0010 | 0.8 | 0.5 | 0.010 | 0.045 | 0.0032 |
| | 2 | 0.088 | 0.08 | 1.5 | 0.005 | 0.0011 | 0.6 | 0.9 | 0.008 | 0.048 | 0.0029 |
| | 3 | 0.085 | 0.20 | 4.0 | 0.004 | 0.0009 | 0.2 | 1.5 | 0.010 | 0.045 | 0.0030 |
| | 4 | 0.096 | 0.26 | 1.3 | 0.005 | 0.0004 | 1.2 | 2.0 | 0.009 | 0.050 | 0.0026 |
| | 5 | 0.102 | 0.18 | 0.9 | 0.006 | 0.0015 | 2.5 | 1.5 | 0.008 | 0.040 | 0.0032 |
| | 6 | 0.108 | 0.20 | 1.0 | 0.006 | 0.0010 | 0.7 | 0.9 | 0.009 | 0.050 | 0.0030 |
| | 7 | 0.118 | 0.22 | 1.1 | 0.005 | 0.0008 | 0.9 | 2.0 | 0.010 | 0.045 | 0.0028 |
| | 8 | 0.122 | 0.24 | 1.1 | 0.004 | 0.0006 | 0.8 | 2.6 | 0.011 | 0.038 | 0.0030 |
| | 9 | 0.124 | 0.13 | 1.0 | 0.003 | 0.0005 | 0.8 | 3.8 | 0.008 | 0.055 | 0.0030 |
| | 10 | 0.130 | 0.23 | 1.0 | 0.005 | 0.0006 | 0.9 | 3.6 | 0.012 | 0.060 | 0.0040 |
| | 11 | 0.135 | 0.19 | 1.3 | 0.005 | 0.0006 | 0.6 | 1.9 | 0.010 | 0.055 | 0.0032 |
| | 12 | 0.158 | 0.22 | 1.2 | 0.004 | 0.0005 | 0.5 | 1.0 | 0.008 | 0.048 | 0.0029 |

TABLE 1-continued

| | | | | | | | | | | | |
|---|---|---|---|---|---|---|---|---|---|---|---|
| | 13 | 0.175 | 0.26 | 0.8 | 0.003 | 0.0003 | 0.8 | 4.5 | 0.009 | 0.053 | 0.0025 |
| | 14 | 0.195 | 0.20 | 0.6 | 0.006 | 0.0009 | 0.8 | 2.2 | 0.011 | 0.050 | 0.0028 |
| | 15 | 0.116 | 0.25 | 1.5 | 0.006 | 0.0005 | | 3.0 | 0.011 | 0.040 | 0.0032 |
| | 16 | 0.122 | 0.10 | 1.5 | 0.003 | 0.0004 | 0.9 | | 0.009 | 0.045 | 0.0028 |
| Comp. | 17 | 0.242 | 0.26 | 1.3 | 0.004 | 0.0008 | 1.0 | 0.6 | 0.012 | 0.040 | 0.0032 |
| Steels | 18 | 0.140 | 0.55 | 1.1 | 0.006 | 0.0007 | 0.8 | 1.0 | 0.009 | 0.045 | 0.0028 |
| | 19 | 0.085 | 0.35 | 0.3 | 0.007 | 0.0009 | 1.2 | 0.9 | 0.009 | 0.050 | 0.0032 |
| | 20 | 0.125 | 0.25 | 1.0 | 0.020 | 0.0012 | 1.0 | 0.9 | 0.009 | 0.043 | 0.0029 |
| | 21 | 0.122 | 0.29 | 1.1 | 0.006 | 0.0005 | 0.8 | 2.0 | 0.003 | 0.050 | 0.0040 |
| | 22 | 0.125 | 0.33 | 1.0 | 0.005 | 0.0006 | 1.0 | 1.9 | 0.024 | 0.035 | 0.0045 |
| | 23 | 0.132 | 0.28 | 1.2 | 0.005 | 0.0009 | 1.1 | 2.0 | 0.009 | 0.003 | 0.0035 |
| | 24 | 0.120 | 0.26 | 1.0 | 0.005 | 0.0009 | 0.9 | 1.9 | 0.011 | 0.095 | 0.0045 |
| | 25 | 0.123 | 0.18 | 1.1 | 0.009 | 0.0006 | 0.8 | 2.0 | 0.010 | 0.040 | 0.0075 |
| | 26 | 0.135 | 0.26 | 1.2 | 0.009 | 0.0008 | 0.8 | 1.9 | 0.008 | 0.050 | 0.0030 |
| | 27 | 0.133 | 0.26 | 1.1 | 0.010 | 0.0010 | 0.8 | 2.0 | 0.008 | 0.050 | 0.0030 |
| | 28 | 0.120 | 0.15 | 0.7 | 0.010 | 0.0015 | 0.6 | 1.0 | 0.012 | 0.035 | 0.0030 |

| Cate- | | Chemical composition (mass %) | | | | | | | Ac3 | Ar3 |
|---|---|---|---|---|---|---|---|---|---|---|
| gories | Steel No. | B | Cu | Mo | V | Ca | REM | $Ceq^{IIW}$ | (° C.) | (° C.) |
| Inv. | 1 | 0.0009 | 0.25 | 0.30 | 0.020 | 0.0015 | | 0.59 | 884 | 704 |
| Steels | 2 | 0.0011 | 0.20 | 0.30 | 0.045 | | 0.0018 | 0.60 | 871 | 676 |
| | 3 | 0.0012 | 0.10 | 0.15 | 0.040 | | | 0.93 | 812 | 465 |
| | 4 | 0.0009 | | 0.25 | | | | 0.74 | 845 | 628 |
| | 5 | 0.0010 | 0.10 | 0.15 | 0.040 | | | 0.90 | 850 | 672 |
| | 6 | 0.0012 | 0.25 | 0.45 | 0.040 | 0.0016 | | 0.58 | 883 | 696 |
| | 7 | 0.0010 | 0.20 | 0.48 | 0.041 | 0.0018 | | 0.73 | 848 | 620 |
| | 8 | 0.0011 | 0.19 | 0.50 | 0.039 | 0.0016 | | 0.76 | 831 | 585 |
| | 9 | 0.0013 | | 0.56 | 0.040 | 0.0015 | | 0.82 | 803 | 526 |
| | 10 | 0.0010 | 0.22 | 0.65 | 0.045 | 0.0018 | | 0.87 | 812 | 522 |
| | 11 | 0.0012 | | | | | 0.0016 | 0.60 | 821 | 651 |
| | 12 | 0.0009 | | 0.50 | | 0.0018 | | 0.62 | 854 | 663 |
| | 13 | 0.0008 | | 0.50 | 0.040 | | | 0.88 | 767 | 492 |
| | 14 | 0.0012 | | 0.65 | | 0.0016 | | 0.73 | 821 | 617 |
| | 15 | 0.0010 | 0.15 | 0.45 | 0.045 | | | 0.68 | 820 | 550 |
| | 16 | 0.0009 | 0.20 | 0.20 | 0.035 | 0.0020 | | 0.61 | 873 | 719 |
| Comp. | 17 | 0.0009 | 0.20 | 0.45 | 0.038 | 0.0019 | | 0.81 | 821 | 643 |
| Steels | 18 | 0.0015 | 0.15 | 0.50 | | | | 0.66 | 881 | 669 |
| | 19 | 0.0012 | 0.22 | 0.60 | 0.039 | 0.0025 | | 0.58 | 920 | 740 |
| | 20 | 0.0010 | 0.20 | 0.55 | 0.045 | | 0.0018 | 0.68 | 879 | 679 |
| | 21 | 0.0011 | | | | 0.0019 | | 0.60 | 830 | 662 |
| | 22 | 0.0008 | | 0.60 | 0.020 | | | 0.74 | 859 | 624 |
| | 23 | 0.0012 | | 0.35 | | | | 0.76 | 827 | 619 |
| | 24 | 0.0006 | 0.45 | 0.45 | | 0.0022 | | 0.71 | 852 | 630 |
| | 25 | 0.0009 | 0.30 | 0.60 | | | | 0.74 | 840 | 608 |
| | 26 | 0.0001 | 0.25 | 0.48 | | 0.0018 | | 0.73 | 835 | 612 |
| | 27 | 0.0040 | 0.25 | 0.49 | | 0.0022 | | 0.72 | 848 | 615 |
| | 28 | 0.0009 | 0.25 | 0.45 | 0.040 | 0.0015 | | 0.54 | 875 | 712 |

Note 1:
Underlined values are outside the inventive ranges.
Note 2:
The values of $Ceq^{IIW}$, Ac3 and Ar3 were calculated using Expressions (1) to (3), respectively.

TABLE 2

| | | | Hot working | | | | | | | | |
|---|---|---|---|---|---|---|---|---|---|---|---|
| Categories | Specimen No. | Steel No | Working method | Heating temp. (° C.) | Working start temp. (° C.) | Working finish temp. (° C.) | Cumulative working reduction (%) | Strain rate (/s) | Maximum reduction per pass (%) | Draft in width direction (mm) | Treatment after hot working |
| Inv. Steels | 1 | 1 | Forging | 1200 | 1185 | 1050 | 15 | 0.1 | 10 | 200 | Air cooling |
| | 2 | 2 | Rolling | 1250 | 1230 | 1120 | 20 | 2.5 | 7 | 0 | Hot rolling without cooling |
| | 3 | 3 | Forging | 1250 | 1230 | 1060 | 20 | 0.1 | 8 | 0 | Air cooling |
| | 4 | 4 | Forging | 1200 | 1190 | 1030 | 15 | 0.1 | 5 | 0 | Hot rolling without cooling |
| | 5 | 5 | Rolling | 1250 | 1220 | 1080 | 15 | 2 | 10 | 0 | Air cooling |
| | 6 | 6 | Rolling | 1200 | 1150 | 1050 | 15 | 2 | 5 | 0 | Air cooling |
| | 7 | 7 | Forging | 1270 | 1265 | 1100 | 20 | 0.1 | 10 | 100 | Air cooling |
| | 8 | 8 | Forging | 1270 | 1265 | 1100 | 20 | 0.1 | 10 | 300 | Air cooling |
| | 9 | 9 | Forging | 1270 | 1265 | 1100 | 20 | 0.1 | 10 | 200 | Air cooling |
| | 10 | 10 | Forging | 1270 | 1265 | 1080 | 25 | 0.1 | 10 | 200 | Hot rolling without cooling |
| | 11 | 11 | Rolling | 1250 | 1230 | 1120 | 20 | 2.5 | 7 | 0 | Air cooling |
| | 12 | 12 | Forging | 1250 | 1245 | 1150 | 15 | 1 | 7 | 0 | Air cooling |
| | 13 | 13 | Forging | 1270 | 1265 | 1100 | 20 | 0.1 | 10 | 300 | Air cooling |
| | 14 | 14 | Forging | 1300 | 1290 | 1150 | 20 | 0.1 | 10 | 200 | Air cooling |

TABLE 2-continued

| Categories | Specimen No. | Steel No | Hot working: Working method | Heating temp. (° C.) | Working start temp. (° C.) | Working finish temp. (° C.) | Cumulative working reduction (%) | Strain rate (/s) | Maximum reduction per pass (%) | Draft in width direction (mm) | Treatment after hot working |
|---|---|---|---|---|---|---|---|---|---|---|---|
| | 15 | 15 | Forging | 1250 | 1235 | 1100 | 20 | 0.1 | 10 | 200 | Air cooling |
| | 16 | 16 | Forging | 1230 | 1190 | 1050 | 15 | 0.1 | 10 | 200 | Air cooling |
| Comp. Steels | 17 | 17 | Forging | 1200 | 1190 | 1030 | 15 | 0.1 | 5 | 0 | Air cooling |
| | 18 | 18 | Forging | 1200 | 1185 | 1050 | 15 | 0.1 | 10 | 100 | Air cooling |
| | 19 | 19 | Forging | 1200 | 1185 | 1050 | 15 | 0.1 | 10 | 200 | Air cooling |
| | 20 | 20 | Forging | 1270 | 1265 | 1100 | 20 | 0.1 | 10 | 200 | Air cooling |
| | 21 | 21 | Forging | 1270 | 1265 | 1100 | 20 | 0.1 | 10 | 200 | Air cooling |

Note:

[e] outside the inventive ranges.

TABLE 3

| Categories | Specimen No. | Steel No. | Hot working: Working method | Heating temp. (° C.) | Working start (° C.) | Working finish (° C.) | Cumulative working reduction (%) | Strain rate (/s) | Maximum reduction per pass (%) | Draft in width direction (mm) | Treatment after hot working |
|---|---|---|---|---|---|---|---|---|---|---|---|
| Comp. Steels | 22 | 22 | Forging | 1270 | 1265 | 1100 | 20 | 0.1 | 10 | 300 | Air cooling |
| | 23 | 23 | Forging | 1270 | 1265 | 1100 | 20 | 0.1 | 10 | 100 | Air cooling |
| | 24 | 24 | Forging | 1270 | 1265 | 1100 | 20 | 0.1 | 10 | 200 | Air cooling |
| | 25 | 25 | Forging | 1270 | 1265 | 1100 | 20 | 0.1 | 10 | 200 | Air cooling |
| | 26 | 26 | Forging | 1270 | 1265 | 1100 | 20 | 0.1 | 10 | 200 | Air cooling |
| | 27 | 27 | Forging | 1270 | 1265 | 1100 | 20 | 0.1 | 10 | 200 | Air cooling |
| | 28 | 28 | Forging | 1270 | 1265 | 1100 | 20 | 0.1 | 10 | 100 | Air cooling |
| | 29 | 7 | Forging | 1050 | 1045 | 850 | 15 | 0.1 | 3 | 0 | Air cooling |
| | 30 | 7 | Forging | 1200 | 1185 | 900 | 15 | 0.1 | 4 | 100 | Air cooling |
| | 31 | 7 | Forging | 1200 | 1190 | 1050 | 7 | 0.2 | 4 | 0 | Air cooling |
| | 32 | 7 | Rolling | 1200 | 1170 | 1050 | 15 | 10 | 8 | 0 | Air cooling |
| | 33 | 7 | Forging | 1250 | 1245 | 1150 | 15 | 0.1 | 8 | 200 | Air cooling |
| | 34 | 9 | Forging | 1270 | 1265 | 1050 | 20 | 0.1 | 7 | 200 | Air cooling |
| | 35 | 9 | Forging | 1270 | 1265 | 1050 | 20 | 0.1 | 8 | 200 | Air cooling |
| | 36 | 9 | Forging | 1270 | 1260 | 1045 | 20 | 0.1 | 7 | 200 | Air cooling |
| | 37 | 9 | Forging | 1250 | 1245 | 1050 | 20 | 0.1 | 8 | 100 | Air cooling |
| | 38 | 9 | Forging | 1250 | 1240 | 1050 | 20 | 0.1 | 8 | 100 | Air cooling |
| | 39 | 9 | Forging | 1270 | 1235 | 1045 | 20 | 0.1 | 8 | 100 | Air cooling |

Note:

Underlined values are outside the inventive ranges.

TABLE 4

| Categories | Specimen No. | Steel No. | Hot rolling: Heating temp (° C.) | Rolling reduction (%) | Number of passes with 4% or more reduction per pass (times) | Plate thickness (mm) | Final heat treatment conditions: Reheating temp. (° C.) | Holding time (min.) | Cooling finish temp. (° C.) | Tempering temp. (° C.) | Base steel characteristic YS (MPa) |
|---|---|---|---|---|---|---|---|---|---|---|---|
| Inv. Steels | 1 | 1 | 1150 | 65 | 5 | 100 | 900 | 10 | 150 | 660 | 711 |
| | 2 | 2 | — | 48 | 5 | 130 | 900 | 30 | 100 | 630 | 723 |
| | 3 | 3 | 1200 | 48 | 4 | 130 | 900 | 30 | 100 | 630 | 721 |
| | 4 | 4 | — | 20 | 3 | 210 | 1000 | 30 | 100 | 600 | 703 |
| | 5 | 5 | 1150 | 43 | 4 | 150 | 1000 | 30 | 100 | 630 | 728 |
| | 6 | 6 | 1100 | 51 | 4 | 130 | 930 | 30 | 100 | 630 | 739 |
| | 7 | 7 | 1200 | 42 | 3 | 150 | 930 | 30 | 150 | 630 | 769 |
| | 8 | 8 | 1200 | 37 | 3 | 180 | 900 | 30 | 100 | 630 | 745 |
| | 9 | 9 | 1200 | 23 | 3 | 210 | 900 | 30 | 100 | 600 | 759 |
| | 10 | 10 | — | 10 | 3 | 240 | 900 | 60 | 100 | 550 | 801 |
| | 11 | 11 | 1150 | 60 | 5 | 100 | 900 | 10 | 200 | 630 | 739 |
| | 12 | 12 | 1150 | 32 | 3 | 180 | 900 | 30 | 100 | 630 | 665 |
| | 13 | 13 | 1200 | 37 | 4 | 180 | 900 | 30 | 100 | 500 | 798 |
| | 14 | 14 | 1200 | 45 | 4 | 150 | 900 | 30 | 150 | 630 | 812 |
| | 15 | 15 | 1200 | 45 | 4 | 150 | 900 | 30 | 100 | 630 | 721 |
| | 16 | 16 | 1150 | 65 | 5 | 100 | 930 | 10 | 100 | 600 | 768 |

TABLE 4-continued

| | | | | | | | | | | | |
|---|---|---|---|---|---|---|---|---|---|---|---|
| Comp. | 17 | 17 | 1100 | 20 | 3 | 210 | 900 | 30 | 100 | 600 | 805 |
| Steels | 18 | 18 | 1150 | 64 | 5 | 100 | 900 | 30 | 150 | 660 | 769 |
| | 19 | 19 | 1150 | 65 | 5 | 100 | 900 | 10 | 150 | 660 | 652 |
| | 20 | 20 | 1200 | 45 | 4 | 150 | 900 | 30 | 150 | 630 | 775 |
| | 21 | 21 | 1200 | 45 | 5 | 150 | 900 | 30 | 150 | 630 | 738 |

| | | | | Base steel characteristics | | | | | Fraction in microstructure (%) (Note 1) | |
|---|---|---|---|---|---|---|---|---|---|---|
| Cate-gories | Speci-men No. | Steel No. | TS (MPa) | t.El (%) | vE-40 (J) | Reduction of area by tension in plate thickness diection (%) | Porosities | Average prior austenite grain size (μm) | Steel plate surface | Central area through plate thickness |
| Inv. | 1 | 1 | 795 | 18.6 | 138 | 37 | Absent | 40 | ≥80 | ≥80 |
| Steels | 2 | 2 | 803 | 16.1 | 141 | 28 | Absent | 38 | ≥80 | ≥80 |
| | 3 | 3 | 806 | 17.2 | 123 | 32 | Absent | 40 | ≥80 | ≥80 |
| | 4 | 4 | 795 | 16.5 | 116 | 30 | Absent | 43 | ≥80 | ≥80 |
| | 5 | 5 | 804 | 16.8 | 135 | 29 | Absent | 46 | ≥80 | ≥80 |
| | 6 | 6 | 812 | 16.2 | 132 | 28 | Absent | 36 | ≥80 | ≥80 |
| | 7 | 7 | 845 | 19.2 | 151 | 39 | Absent | 41 | ≥80 | ≥80 |
| | 8 | 8 | 809 | 18.1 | 216 | 38 | Absent | 39 | ≥80 | ≥80 |
| | 9 | 9 | 832 | 17.5 | 225 | 36 | Absent | 43 | ≥80 | ≥80 |
| | 10 | 10 | 865 | 18.8 | 193 | 35 | Absent | 46 | ≥80 | ≥80 |
| | 11 | 11 | 801 | 16.6 | 163 | 28 | Absent | 33 | ≥80 | ≥80 |
| | 12 | 12 | 748 | 21.5 | 186 | 35 | Absent | 30 | ≥80 | ≥80 |
| | 13 | 13 | 859 | 20.2 | 198 | 36 | Absent | 36 | ≥80 | ≥80 |
| | 14 | 14 | 883 | 18.5 | 128 | 37 | Absent | 44 | ≥80 | ≥80 |
| | 15 | 15 | 806 | 17.3 | 203 | 36 | Absent | 32 | ≥80 | ≥80 |
| | 16 | 16 | 845 | 18.3 | 115 | 38 | Absent | 29 | ≥80 | ≥80 |
| Comp. | 17 | 17 | 883 | 16.0 | 49 | 28 | Absent | 45 | ≥80 | ≥80 |
| Steels | 18 | 18 | 835 | 17.8 | 55 | 36 | Absent | 30 | ≥80 | ≥80 |
| | 19 | 19 | 722 | 18.2 | 36 | 39 | Absent | 29 | ≥80 | ≥80 |
| | 20 | 20 | 848 | 17.3 | 22 | 35 | Absent | 36 | ≥80 | ≥80 |
| | 21 | 21 | 801 | 17.3 | 32 | 36 | Absent | 39 | ≥80 | ≥80 |

Note 1

Martensite and/or bainite area fraction

TABLE 5

| | | | Hot rolling | | | | Final heat treatment conditions | | | | Base steel |
|---|---|---|---|---|---|---|---|---|---|---|---|
| Cate-gories | Speci-men No. | Steel No. | Heating temp. (° C.) | Rolling reduction (%) | Number of passes with 4% or more reduction per pass (times) | Plate thickness (mm) | Reheating temp. (° C.) | Holding time (min.) | Cooling finish temp. (° C.) | Temp-ering temp. (° C.) | charac-teristic YS (MPa) |
| Comp. | 22 | 22 | 1200 | 48 | 4 | 150 | 900 | 30 | 150 | 630 | 768 |
| Steels | 23 | 23 | 1200 | 42 | 5 | 150 | 900 | 30 | 150 | 630 | 649 |
| | 24 | 24 | 1200 | 45 | 4 | 150 | 900 | 30 | 150 | 630 | 750 |
| | 25 | 25 | 1200 | 45 | 4 | 150 | 900 | 30 | 150 | 630 | 682 |
| | 26 | 26 | 1200 | 34 | 4 | 180 | 900 | 30 | 100 | 630 | 539 |
| | 27 | 27 | 1200 | 34 | 3 | 180 | 900 | 30 | 100 | 630 | 789 |
| | 28 | 28 | 1200 | 31 | 3 | 180 | 900 | 30 | 100 | 630 | 563 |
| | 29 | 7 | 1150 | 43 | 4 | 150 | 900 | 30 | 150 | 630 | 763 |
| | 30 | 7 | 1150 | 46 | 4 | 150 | 900 | 30 | 150 | 630 | 748 |
| | 31 | 7 | 1150 | 48 | 3 | 150 | 900 | 30 | 100 | 630 | 785 |
| | 32 | 7 | 1100 | 43 | 3 | 150 | 900 | 30 | 150 | 630 | 761 |
| | 33 | 7 | 800 | 48 | 4 | 150 | 900 | 30 | 100 | 630 | 735 |
| | 34 | 9 | 1150 | 23 | 3 | 210 | 1100 | 10 | 150 | 600 | 762 |
| | 35 | 9 | 1150 | 23 | 3 | 210 | 750 | 30 | 100 | 600 | 610 |
| | 36 | 9 | 1100 | 23 | 3 | 210 | 900 | 30 | 450 | 600 | 593 |
| | 37 | 9 | 1100 | 19 | 2 | 210 | 900 | 30 | 150 | 730 | 576 |
| | 38 | 9 | 1100 | 19 | 3 | 210 | 900 | 30 | 150 | 380 | 871 |
| | 39 | 9 | 1100 | 19 | 1 | 210 | 900 | 30 | 150 | 630 | 769 |

TABLE 5-continued

| Categories | Specimen No. | Steel No. | Base steel characteristics TS (MPa) | t. El (%) | vE-40 (J) | Reduction of area by tension in plate thickness direction (%) | Porosities | Average prior austenite grain size (μm) | Fraction in microstructure (%) (Note 2) Steel plate surface | Central area through plate thickness |
|---|---|---|---|---|---|---|---|---|---|---|
| Comp. Steels | 22 | 22 | 830 | 17.0 | 29 | 35 | Absent | 46 | ≥80 | ≥80 |
| | 23 | 23 | 726 | 17.4 | 24 | 36 | Absent | 43 | ≥80 | ≥80 |
| | 24 | 24 | 803 | 18.2 | 41 | 35 | Absent | 45 | ≥80 | ≥80 |
| | 25 | 25 | 733 | 17.1 | 39 | 36 | Absent | 40 | ≥80 | ≥80 |
| | 26 | 26 | 634 | 19.1 | 19 | 35 | Absent | 42 | ≥80 | 50 |
| | 27 | 27 | 869 | 18.3 | 52 | 38 | Absent | 41 | ≥80 | ≥80 |
| | 28 | 28 | 685 | 21.2 | 26 | 36 | Absent | 44 | ≥80 | 45 |
| | 29 | 7 | 829 | 10.5 | 103 | 16 | Present | 33 | ≥80 | ≥80 |
| | 30 | 7 | 816 | 8.6 | 86 | 15 | Present | 39 | ≥80 | ≥80 |
| | 31 | 7 | 863 | 6.9 | 92 | 18 | Present | 41 | ≥80 | ≥80 |
| | 32 | 7 | 831 | 5.3 | 115 | 8 | Present | 39 | ≥80 | ≥80 |
| | 33 | 7 | 819 | 16.1 | 48 | 36 | Absent | 112 | ≥80 | 25 |
| | 34 | 9 | 841 | 16.0 | 35 | 30 | Absent | 74 | ≥80 | ≥80 |
| | 35 | 9 | 682 | 16.4 | 215 | 33 | Absent | 105 | ≥80 | ≥80 |
| | 36 | 9 | 645 | 16.3 | 39 | 32 | Absent | 43 | ≥80 | 30 |
| | 37 | 9 | 633 | 16.2 | 221 | 35 | Absent | 45 | ≥80 | ≥80 |
| | 38 | 9 | 1025 | 16.5 | 16 | 36 | Absent | 41 | ≥80 | ≥80 |
| | 39 | 9 | 858 | 16.3 | 32 | 29 | Absent | 85 | ≥80 | ≥80 |

Note 1
Underlined values are outsidethe inventive ranges.
Note 2
Martensite and/or bainite area fraction

The invention claimed is:

1. A thick, high-toughness high-strength steel plate having a plate thickness of not less than 100 mm, the steel plate comprising a microstructure having, throughout the plate thickness direction, an average prior austenite grain size of not more than 50 μm and a martensite and/or bainite phase area fraction of not less than 80%, the yield strength of the steel plate is not less than 620 MPa, a reduction of area after fracture in a tensile test in the direction of the plate thickness of the steel plate is not less than 25%, an absorbed energy by Charpy impact test at −40° C. $vE_{-40}$ of the steel plate is 70 J or more, the steel plate includes by mass %, C: 0.08 to 0.20%, Si: not more than 0.40%, Mn: 0.5 to 5.0%, P: not more than 0.015%, S: not more than 0.0050%, Cr: not more than 3.0%, Ni: not more than 5.0%, Ti: 0.005% to 0.020%, Al: 0.010 to 0.080%, N: not more than 0.0070% and B: 0.0003 to 0.0030%, the balance being Fe and inevitable impurities, and the steel plate satisfies the relationship represented by Expression (1)

$$Ceq^{IIW}=C+Mn/6+(Cu+Ni)/15+(Cr+Mo+V)/5\geq 0.57 \quad (1)$$

wherein the alloying element symbols indicate the respective contents (mass %) and are 0 when absent.

2. A method of manufacturing a thick, high-toughness high-strength steel plate having a plate thickness of not less than 100 mm, the steel plate including a microstructure having throughout an entire region in the plate thickness direction, an average prior austenite grain size of not more than 50 μm and a martensite and/or bainite phase area fraction of not less than 80%, the method comprising:

heating a continuously cast slab to 1200° C. to 1350° C., hot working the slab at not less than 1000° C. with a strain rate of not more than 3/s and a cumulative working reduction of not less than 15%, and hot rolling, quench hardening and tempering the steel, the continuously cast slab including, by mass %, C: 0.08 to 0.20%, Si: not more than 0.40%, Mn: 0.5 to 5.0%, P: not more than 0.015%, S: not more than 0.0050%, Cr: not more than 3.0%, Ni: not more than 5.0%, Ti: 0.005% to 0.020%, Al: 0.010 to 0.080%, N: not more than 0.0070% and B: 0.0003 to 0.0030%, the balance being Fe and inevitable impurities, the continuously cast slab satisfying the relationship represented by Expression (1):

$$Ceq^{IIW}=C+Mn/6+(Cu+Ni)/15+(Cr+Mo+V)/5\geq 0.57 \quad (1)$$

wherein the alloying element symbols indicate the respective contents (mass %) and are 0 when absent, wherein the continuously cast slab is heated to 1200° C. to 1350° C., hot worked at not less than 1000° C. with a strain rate of not more than 3/s and a cumulative working reduction of not less than 15%, air cooled, heated again to Ac3 point to 1200° C., subjected to hot rolling including at least two or more passes with a rolling reduction per pass of not less than 4%, air cooled, heated to Ac3 point to 1050° C., quenched to 350° C. or below and tempered at 450° C. to 700° C., and wherein the yield strength is not less than 620 MPa.

3. The method according to claim 2, wherein the slab further includes, by mass %, one, or two or more of Cu: not more than 0.50%, Mo: not more than 1.00% and V: not more than 0.200%.

4. The method according to claim 2, wherein the slab further includes, by mass %, one or both of Ca: 0.0005 to 0.0050% and REM: 0.0005 to 0.0050%.

5. The method according to claim 2, wherein the continuously cast slab is worked to reduce its width by not less than 100 mm before hot working and is thereafter hot worked with a strain rate of not more than 3/s and a cumulative working reduction of not less than 15%.

6. The method according to claim 3, wherein the slab further includes, by mass %, one or both of Ca: 0.0005 to 0.0050% and REM: 0.0005 to 0.0050%.

7. The steel plate according to claim 1, wherein steel plate further includes, by mass %, one, or two or more of Cu: not more than 0.50%, Mo: not more than 1.00% and V: not more than 0.200%.

8. The steel plate according to claim 1, wherein steel plate further includes, by mass %, one or both of Ca: 0.0005 to 0.0050% and REM: 0.0005 to 0.0050%.

9. The steel plate according to claim 7, wherein steel plate further includes, by mass %, one or both of Ca: 0.0005 to 0.0050% and REM: 0.0005 to 0.0050%.

* * * * *